US009151186B2

(12) United States Patent
Meusel et al.

(10) Patent No.: US 9,151,186 B2
(45) **Date of Patent: *Oct. 6, 2015**

(54) TUBE SHAFT WITH INTEGRATED OIL SEPARATOR

(75) Inventors: Jürgen Meusel, Dittmansdorf (DE); Ulf Müller, Chemnitz (DE); Andreas Stapelmann, Chemnitz (DE); Daniel Paul, Burkarsdorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 427 days.

This patent is subject to a terminal disclaimer.

(21) Appl. No.: 13/203,895

(22) PCT Filed: Jan. 16, 2010

(86) PCT No.: PCT/EP2010/000230

§ 371 (c)(1),
(2), (4) Date: Aug. 30, 2011

(87) PCT Pub. No.: WO2010/102688

PCT Pub. Date: Sep. 16, 2010

(65) Prior Publication Data

US 2011/0312427 A1 Dec. 22, 2011

(30) Foreign Application Priority Data

Mar. 10, 2009 (DE) ..... 10 2009 012 402

(51) Int. Cl.

| | |
|---|---|
| ***F16C 3/02*** | (2006.01) |
| ***F01L 1/047*** | (2006.01) |
| ***F01M 13/04*** | (2006.01) |

(52) U.S. Cl.
CPC ..... *F01L 1/047* (2013.01); *F01M 13/04* (2013.01); *F01M 13/0416* (2013.01); *F01M 2013/0422* (2013.01)

(58) Field of Classification Search
CPC F01M 2013/0422; F01M 13/04; F01L 1/047; F02M 25/06
USPC ..... 184/55.1; 123/572; 464/183
See application file for complete search history.

(56) References Cited

U.S. PATENT DOCUMENTS

| | | | | | |
|---|---|---|---|---|---|
| 1,979,025 | A | * | 10/1934 | Carvelli | 184/6.5 |
| 2,818,047 | A | * | 12/1957 | Powell | 92/78 |
| 4,189,310 | A | * | 2/1980 | Hotta | 55/317 |
| 4,329,968 | A | * | 5/1982 | Ishikawa et al. | 123/573 |
| 4,651,704 | A | * | 3/1987 | Sekiguchi | 123/572 |
| 6,308,621 | B1 | * | 10/2001 | Douillard et al. | 101/216 |
| 7,309,308 | B2 | * | 12/2007 | Berger et al. | 494/81 |
| 7,455,057 | B2 | * | 11/2008 | Hochmayr et al. | 123/572 |

(Continued)

*Primary Examiner* — Michael Mansen
*Assistant Examiner* — Michael Riegelman
(74) *Attorney, Agent, or Firm* — Andrew Wilford

(57) ABSTRACT

An oil-laden gas stream flows axially through a tube shaft formed with at least one radially throughgoing inner oil-discharge port and, axially downstream therefrom, with at lest one radially throughgoing inner gas-discharge port. A bearing supports the tube shaft for rotation about the axis and is formed axially level with the ports with respective radially throughgoing outer oil-discharge and gas-discharge ports. An oil separator inside the tube shaft axially between the oil-discharge ports and the gas-discharge ports is oriented to deflect oil particles from the stream radially outward such that the oil flows out through the inner and outer oil-discharge ports and the gas stream can flow downstream out through the gas-discharge ports.

12 Claims, 1 Drawing Sheet

(56) References Cited

U.S. PATENT DOCUMENTS 7,717,101 B2 * 5/2010 Beetz et al. ..... 123/572
8,166,958 B2 * 5/2012 Rice et al. ..... 123/572
8,409,309 B2 * 4/2013 Meusel et al. ..... 55/357
8,496,721 B2 * 7/2013 Meusel et al. ..... 55/457
2005/0121262 A1 * 6/2005 Berger et al. ..... 184/6.21

* cited by examiner

TUBE SHAFT WITH INTEGRATED OIL SEPARATOR

CROSS-REFERENCE TO RELATED APPLICATIONS

This application is the US-national stage of PCT application PCT/EP2010/000230 filed 16 Jan. 2010 and published 16 Sep. 2010 with a claim to the priority of German patent application DE 10 2009 012 402.0 filed 10 Mar. 2009.

FIELD OF THE INVENTION

The present invention refers to a tube shaft, especially to a camshaft rotatable in a bearing with an integrated oil separation device integrated into a cavity of the tube shaft, the tube shaft having at least one feed opening for the introduction of oil-laden gas into the cavity and at least one discharge opening for draining separated oil and gas that is freed of oil.

BACKGROUND OF THE INVENTION

A tube shaft, constructed as a camshaft, with an integrated separation device, is already known from WO 2006/119737 (U.S. Pat. No. 7,717,101), where in addition to a preseparator the outer periphery of the camshaft is provided with a swirler serving as a final separator and integrated into the cavity of the camshaft.

Object of the Invention

The object of the present invention is to provide a generic-type tube shaft with integrated oil separation device of construction that is as compact and space saving as possible is ensured.

SUMMARY OF THE INVENTION

According to the invention, this object is achieved by a tube shaft formed with at least one radial discharge opening and the bearing has a radial discharge passage aligned with the tube-shaft discharge opening. Owing to the fact that the at least one discharge opening (especially the oil radial discharge opening) provided on the convex surface side and advantageously all the existing discharge openings for the oil to be discharged and the gas to be discharged is, or are, provided in the region of a bearing surrounding the tube shaft, and that the at least one discharge opening of the tube shaft corresponds to at least one corresponding discharge passage of the bearing, an exceptionally space-saving and compact construction of the tube shaft with integrated oil separation device is ensured. In a simple embodiment, the draining of the separated oil could be carried out by one or more radial discharge openings in the tube shaft axially level with at least one discharge passage of the bearing, whereas the discharging of the gas flow could be carried out axially via the open end of the tube shaft. For the preferred case in which both the draining of the oil and the discharging of the cleaned gas are to be carried out via radial discharge openings, the at least one convex surface-side gas discharge opening is provided downstream of the at least one convex surface-side oil discharge opening, as seen in the flow direction. For diverting the axially flowing air or gas flow into the radial gas discharge openings of the tube shaft wall, a correspondingly designed flow-guiding element is provided inside the tube shaft. This flow-guiding element can be designed as a plug-like component in such a way that the axially flowing gas is diverted at least in part toward the at least one gas discharge opening. To this end, the flow-guiding element can be essentially of a conical design and orientated by its cone point against the flow direction The flow-guiding element can be of a design that is impermeable by gas or air so that the entire gas flow is diverted/discharged radially outward into the gas discharge opening(s) by the flow-guiding element. Alternatively, the flow-guiding element can also be designed in such a way that it axially passes through a predetermined gas or air flow in the case of a known flow pressure, while the remaining portion is diverted/discharged radially outward into the gas discharge openings. In another possible embodiment, the flow element can also have an axial bypass channel that, via a pressure-dependent bypass valve (for example with a spring force-loaded check valve), is opened when a predetermined pressure is exceeded so that when the predetermined pressure is exceeded a portion of the cleaned gas flow is discharged via the bypass valve and a remaining portion is discharged via the convex surface-side gas discharge opening(s).

The integrated oil separation device is advantageously of a multistage construction. In this case, a first oil separation stage is advantageously formed by a so-called swirler. This swirler can be designed, for example, as a body that extends in the cavity of the tube shaft in the axial direction and that circumferentially has at least one screw thread flight such that the screw thread flight defines a flow passage for guiding the introduced oil-laden gas or oil-laden (or laden with oil droplets) air (subsequently also referred to as blow-by gas or oil mist) between the body of the swirler and the inner wall of the tube shaft. A second oil separation stage can be formed by an oil separation ring provided downstream of the swirler, as seen in the flow direction. In this case, the oil separation ring is advantageously of a solid design such that in the edge flow region of the cavity of the tube shaft it constitutes a corresponding flow obstruction for the oil-enriched gas (or air) in this region (on account of the rotation/centrifugal force).

BRIEF DESCRIPTION OF THE DRAWING

Further advantages, features and expedient developments of the invention come from the dependent claims and from the subsequent illustrations of preferred exemplary embodiments. In the drawings:

SPECIFIC DESCRIPTION OF THE INVENTION

Figure 1:
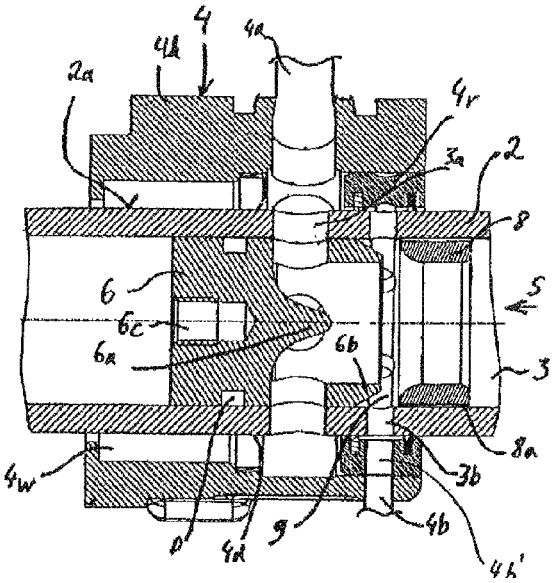
FIG. 1 is a section through the tube shaft according to the invention, with the convex surface-side discharge passages for oil and gas which are provided in the region of a bearing that supports the tube shaft, in a first possible embodiment, as seen in longitudinal section.

In FIG. 1, a tube shaft 2 rotatably supported in a bearing 4 with an integrated oil separation device is shown in a partial longitudinal section. The bearing 4 comprises a bearing body 4*k* that can be constructed either in the form of a bearing block (formed by a part of the cylinder head, for example) or that can be constructed as a separate component that can be fastened onto the cylinder head. For rotatable support of the tube shaft 2, the bearing 4 can be constructed in the form of the bearing body 4*k* that on its cylindrical inner surface is designed in such a way to form a friction bearing together with a hardened region (bearing section 2*a*) of the tube shaft 2. In another embodiment of the bearing 4, it can have a multiplicity of rolling elements 4*w* over its cylindrical inner surface, by means of which the tube shaft 2 that is surface-hardened at least in sections is rotatably supported. In the latter case illustrated in FIGS. 1 and 2, the bearing 4 has a seal ring 4*d* by means of which the adjacent gas discharge passage 4*a* is sealed relative to the region with rolling elements 4*w*. As a result of this, the effect of uncleaned gas being drawn into the gas discharge passage 4*a* and being fed to the internal combustion engine is prevented.

The tube shaft 2 has at least one essentially radial discharge opening 3*b* for draining oil that is separated from the so-called blow-by gas. Thus, there are radial discharge openings 3*a*, 3*b* respectively for gas and oil, and the tube shaft 2 is supported in the region of the discharge openings 3*a*, 3*b* by the bearing 4. In the region of the oil discharge openings 3*b*, a radial seal ring 4*r*, which has at least one oil passage 4*b*' that corresponds to the oil discharge opening 3*b* and also to the oil discharge passage 4*b*, is provided in the bearing 4 or in its bearing body 4*k*. On its inner surface, the radial seal ring 4*r* has a radially inwardly open circumferential groove in which oil that is deposited on the inner wall of the tube shaft 2 and exits through the circumferentially distributed oil discharge openings 3*b* can be received and discharged via the oil passage 4*b*' that open into the groove. The radial seal ring 4*r*, which is retained circumferentially in the bearing 4 in a friction fit and which via its sealing lips projecting radially inward toward the tube shaft surface, is sealed relative to the tube shaft 2 that rotates in the radial seal ring 4*r*, a reliable draining of the separated oil is ensured and drawing in of oil into the adjacent gas discharge passage 4*a* is reliably prevented.

In the illustrated embodiment, the tube shaft 2 is rotatably supported in the bearing 4 via the rolling elements 4*w*. The bearing section(s) 2*a* of the tube shaft 2 that interact(s) with the rolling elements 4*w* (rolling bearings) or with regions of the bearing body 4*k* (friction bearing) can be constructed as a hardened and/or surface-treated tube shaft section, or sections. If the bearing 4 is not constructed as a friction bearing but as a rolling bearing, provision is made in the bearing 4 or in the bearing body 4*k* for regions that are free of rolling elements for provision of the discharge openings for oil or for oil and gas. In the region of the tube shaft 2 in which it interacts with the bearing 4 or is enclosed by it, provision is made for at least one radial discharge opening (or discharge hole) 3*a*, 3*b* for discharging gas or oil. A plurality of holes angularly distributed around the tube shaft 2 are advantageously provided as discharge openings for gas or oil in such a way that a ring of holes, consisting of a multiplicity of angularly spaced holes is formed for discharging the cleaned blow-by gases, and a ring of holes is formed for draining oil separated from the blow-by gas. Each radially extending discharge opening 3*a*, 3*b* interacts in this case with a discharge passage 4*a*, 4*b* that is formed in the bearing 4 or in the bearing body 4*k* and corresponds to the respective discharge opening 3*a*, 3*b*. The discharge passage 4*a*, 4*b* of the respective discharge openings 3*a*, 3*b* is constructed inside the bearing 4 as an annular passage with at least one corresponding radial discharge section for discharging the oil or gas that is to be discharged from the tube shaft 2.

Figure 2:
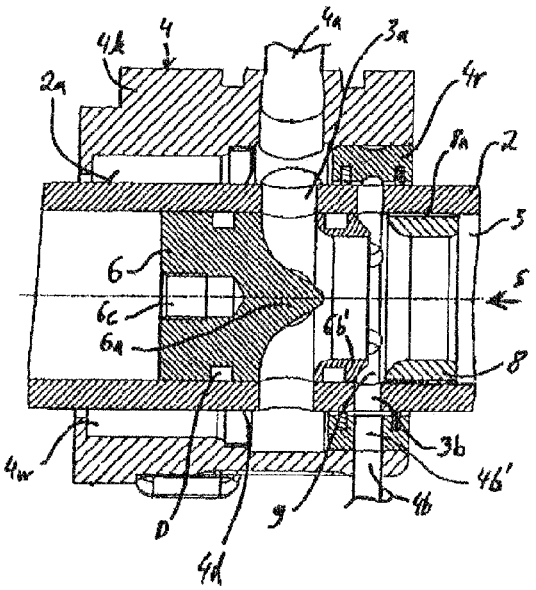
FIG. 2 shows a further possible embodiment of the tube shaft according to the invention with a slightly modified is construction of the flow-guiding element.

In order to be able to separately discharge the blow-by gas with its separated constituents, having already been basically separated into its gas and oil constituents in the region of the discharge openings 3*a*, 3*b*, a flow-guiding element 6 is provided inside the cavity 3 of the tube shaft 2 to radially outwardly deflect the axially flowing gas into the at least one radial gas discharge opening 3*a*. In this case, the flow-guiding element 6 is provided with an annular seal D in order to be able to discharge all the gas fraction of the cleaned blow-by gas as much as possible via the radial discharge openings 3*a*. To this end, the flow-guiding element 6 is designed essentially like a plug or cork and on its end face turned toward the inflowing gas has a basically centrally orientated conical extension 6*a*. On the opposite end face, the flow-guiding element 6 has a threaded hole 6*c*. This threaded hole serves especially for simple removal of the illustrated device. In order to be able to separately drain the oil deposited by the integrated oil separation device on the inner wall 2*b* of the tube shaft 2, an oil-guiding element 6*b* is provided between the oil discharge opening 3*b* and the at least one gas discharge opening 3*a* that is downstream of the at least one oil discharge opening 3*b*, as seen in the flow direction S. The oil-guiding element 6*b*, as shown in FIG. 1, can be constructed in one piece with the flow-guiding element 6. In another embodiment of the invention, as shown in FIG. 2, the oil-guiding element 6*b*' can be designed as a separate component in the form of a separation ring provided between the gas discharge openings 3*a* and the oil discharge openings 3*b*.

The integrated oil separation device advantageously comprises at least two differently acting oil separation elements. In this case, a first oil separation element is designed in the form of a so-called swirler (not shown), for example, whereas a second oil separation element is constructed in the form of an oil separation ring 8 that is downstream of the first oil separation element, as seen in the flow direction S. As a result of the geometric arrangement of the oil separation ring 8, which is provided directly upstream of the oil discharge opening 3*b* as seen in the flow direction S, and of the oil-guiding element 6*b*; 6*b*' provided directly downstream of the oil discharge opening 3*b* (but still upstream of the gas discharge opening 3*a*) as seen in the flow direction S, a calm-flow d region 9 is formed. On account of the calm-flow region 9, efficient draining of oil and also improved separation (or maintaining of the separation) between the clean gas constituents and the separated oil constituents can be achieved.

Figure 3:
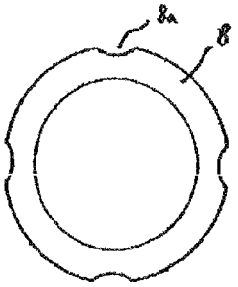
FIG. 3 shows an oil separation ring in a possible first embodiment, as seen in cross section.
Figure 4:
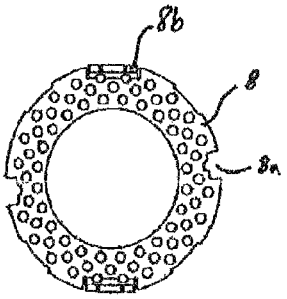
FIG. 4 shows the oil separation ring according to FIG. 3 in a further possible embodiment, as seen in partial cross section.

In FIGS. 3 and 4, a possible embodiment of an oil separation ring is shown in each case. According to FIG. 3, the oil separation ring 8 is essentially of solid design and constitutes a large flow obstruction in the form of an impingement element for the flow of the blow-by gas near the inner wall of the tube shaft 2. The oil particles suspended in the blow-by gas cannot follow the quick change of direction around the oil separation ring 8, impinge against the end face of the oil separation ring 8, and so are separated out from the oil mist. The oil separation ring 8 has a multiplicity of axially extending recesses 8*a* via which the oil particles deposited on the wall side or the oil film formed therefrom on the wall surface, can flow further in the flow direction S toward the oil discharge opening 3*b*.

The oil separation ring 8 advantageously has a system of interconnected cavities so that a labyrinth of cavities that extend through the oil separation ring 8 is formed. The end face of the oil separation ring 8 additionally constitutes an impingement element, whereas the inner labyrinth is a combination of impingement and deflection elements. By means of these impingement and deflection elements, lighter oil particles are also separated out from the oil mist so that the oil mist that flows downstream of the oil separation ring 8, as seen in the flow direction S, can be considered to be cleaned gas or cleaned air. Materials for the aforesaid configurations of the oil separation ring 8 may be, for example, porous plastics or synthetic materials. The oil separation ring 8 preferably also comprises a plastic mesh and/or metal mesh that forms, or form, a large number of cavities and labyrinths, in which case the oil separation ring 8 then preferably comprises a support ring that is supports the mesh and, moreover, serves for fixing the mesh in the cavity 3 of the tube shaft 2.

In one embodiment of the oil separation ring 8, as illustrated in FIG. 4, the oil separation ring 8 comprises a perforated sheet-metal ring. Such an oil separation ring 8 advantageously comprises a multiplicity of sheet-metal rings that are arranged in series and rotated or offset relative to each other with the respective hole rows or hole patterns and that are spaced apart and interconnected via circumferential connecting elements 8*b*. As a result of the offset or the angular offset of the individual sheet-metal rings relative to each other and the corresponding spacing apart of the individual sheet-metal rings, a corresponding labyrinth is created for separating oil from the blow-by gas that flows through the oil separation ring 8.

The invention claimed is:

1. In combination:

a tube shaft extending along an axis, whereby an oil-laden gas stream flows in one axial direction inside the tube shaft, the tube shaft being formed with a radially throughgoing inner oil-discharge port and, axially downstream therefrom, with a radially throughgoing inner gas-discharge port;

a bearing supporting the tube shaft for rotation about the axis and formed with axially spaced and radially throughgoing outer oil-discharge and gas-discharge ports radially respectively alignable with the inner oil-discharge and gas-discharge ports; and an oil separator inside the tube shaft axially between the inner oil-discharge and the gas-discharge ports and oriented to deflect oil particles from the stream radially outward such that the oil flows radially outward through the inner and outer oil-discharge ports and the gas stream can flow downstream past the separator and radially outward through the inner and outer gas-discharge ports.

2. The combination defined in claim 1, further comprising:

a flow-guiding element fixed in the tube shaft immediately downstream of the inner gas-discharge port and oriented to deflect the gas stream from which the oil separator has stripped oil particles radially outwardly into the gas-discharge port.

3. The combination defined in claim 2, wherein the flow-guiding element has generally centered on the axis a conical extension pointing axially upstream against the axial flow direction.

4. The combination defined in claim 1, further comprising:

a seal between the bearing and an outside surface of the tube shaft immediately downstream of the oil-discharge port.

5. The combination defined in claim 4, wherein the bearing is provided downstream of the seal with roller elements engaging an outer surface of the tube shaft and an inner surface of the bearing.

6. The combination defined in claim 1, wherein the bearing is a slide bearing.

7. The combination defined in claim 1, wherein there are a plurality of the gas-discharge ports angularly spaced around the tube shaft downstream of the oil separator and a plurality of the oil-discharge ports angularly spaced around the tube shaft upstream of the oil separator.

8. The combination defined in claim 1, wherein the oil separator is a ring fitted coaxially inside the tube shaft.

9. The combination defined in claim 8, wherein the ring has an outer surface formed with a plurality of axially throughgoing recesses and bearing on an inner surface of the tube.

10. The combination defined in claim 8, wherein the ring is formed with an array of axially throughgoing small holes.

11. The combination defined in claim 1, further comprising:

a seal ring radially inwardly engaging an outer surface of the tube shaft at the oil-discharge port, radially outwardly engaging an inner surface of the bearing, and formed with the outer oil-discharge port.

12. The combination defined in claim 11, wherein the seal ring is formed with a radially inwardly open annular groove into which all of the outer oil-discharge port open radially inwardly and all of the inner oil-discharge port open radially outwardly.

* * * * *